US007384508B2

(12) United States Patent
Tahti

(10) Patent No.: US 7,384,508 B2
(45) Date of Patent: Jun. 10, 2008

(54) APPARATUS AND METHOD FOR DRAINING WATER FROM A CELLULOSE WEB

(75) Inventor: Harri Tahti, Karhula (FI)

(73) Assignee: Metso Paper, Inc., Helsinki (FI)

( * ) Notice: Subject to any disclaimer, the term of this patent is extended or adjusted under 35 U.S.C. 154(b) by 448 days.

(21) Appl. No.: 10/416,563

(22) PCT Filed: Nov. 16, 2001

(86) PCT No.: PCT/FI01/00995

§ 371 (c)(1),
(2), (4) Date: Oct. 20, 2003

(87) PCT Pub. No.: WO02/40770

PCT Pub. Date: May 23, 2002

(65) Prior Publication Data

US 2004/0045689 A1 Mar. 11, 2004

(30) Foreign Application Priority Data

Nov. 16, 2000 (FI) ..... 20002511

(51) Int. Cl.
*D21F 1/66* (2006.01)

(52) U.S. Cl. ..... 162/189; 162/198; 162/272; 162/363; 162/300; 162/372

(58) Field of Classification Search ..... 162/189, 162/198, 272, 363, 203, 205, 206, 300, 305, 162/372
See application file for complete search history.

(56) References Cited

U.S. PATENT DOCUMENTS 2,067,876 A * 1/1937 Campbell ..... 162/181.3
4,172,759 A 10/1979 Kankaapää

FOREIGN PATENT DOCUMENTS

WO WO 0031337 * 5/2000

* cited by examiner

*Primary Examiner*—Mark Halpern
(74) *Attorney, Agent, or Firm*—Alston & Bird LLP

(57) ABSTRACT

An apparatus and a method are provided for draining water from a cellulose web which is formed in a wedge-shaped space defined by two wires, the wires being supported on chamber assemblies including at one time at least one water receiving chamber, the water flowing therein through the wire as a result of a pressure difference. Each water receiving chamber has connected thereto at least one substantially vertical pipe having a vertical drop between its top and bottom end sufficient for developing a gravitational suction leg in the water flowing pipe, and the pipe terminating in a water receiver.

10 Claims, 1 Drawing Sheet

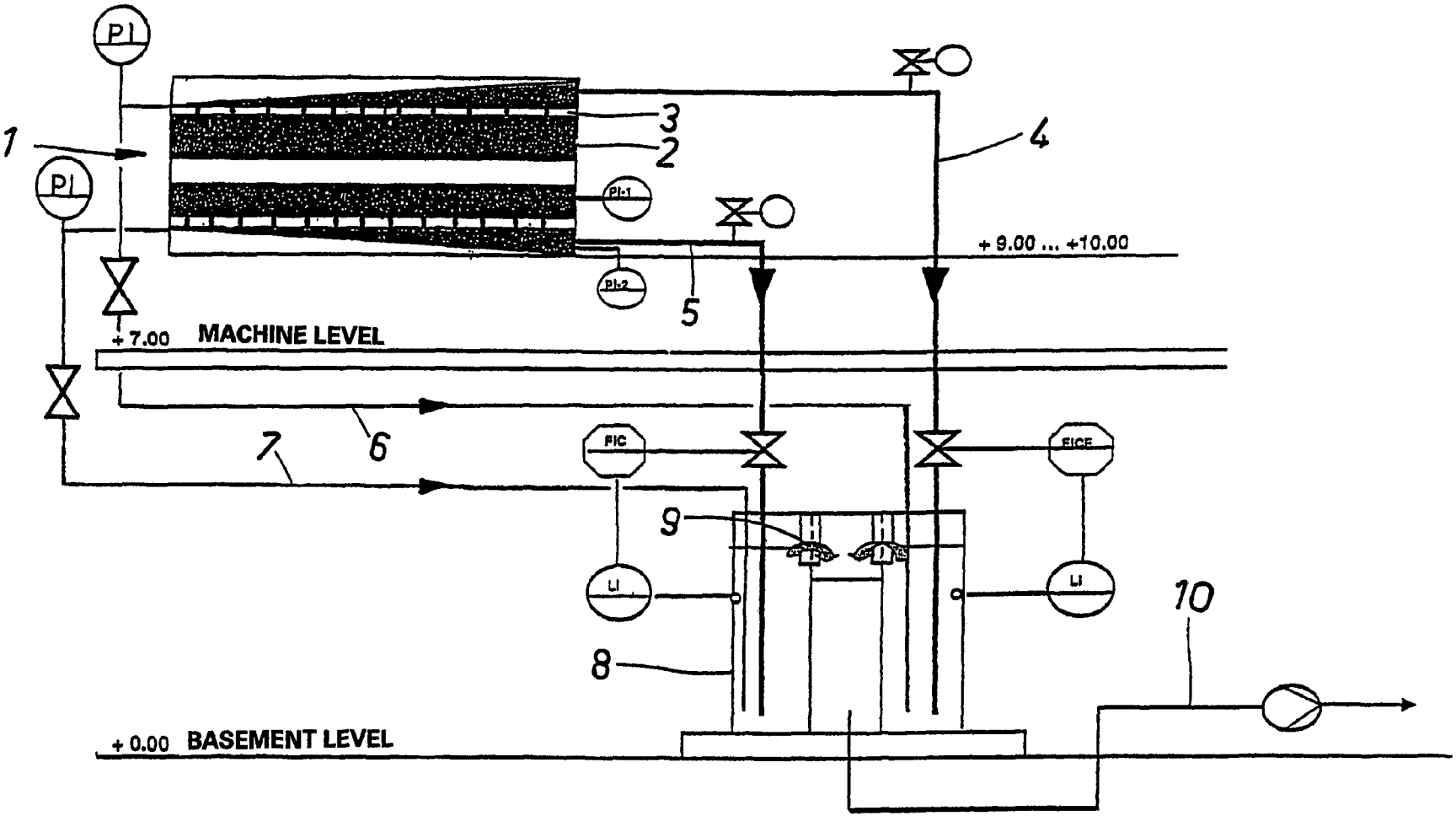
1
2
3
4
5
6
7
8
9
10
PI
PI
PI-1
PI-2
+7.00
MACHINE LEVEL
+9.00 ... +10.00
FICE
LI
PIC
LI
+0.00
BASEMENT LEVEL

APPARATUS AND METHOD FOR DRAINING WATER FROM A CELLULOSE WEB

This application is a 371 of PCT/FI01/00995 filed 16 Nov. 2001.

BACKGROUND OF THE INVENTION

1. Field of the Invention

The present invention relates to an apparatus for draining of water from a cellulose web, said web being formed in a wedge-shaped space defined by two wires, and said wires being supported by chamber assemblies, including at least one water receiving chamber at one time, the water from suspension stock flowing therein through the wire as a result of a pressure difference.

2. Description of Related Art

A web forming apparatus of the above type is prior known e.g. from Finnish Patent Application No. 982539 to Metso Paper, Inc. In this prior known apparatus, the water-receiving chambers set behind the wire are provided with dewatering elements. It is an object of the present invention to provide an effective and simple alternative solution to this dewatering system.

BRIEF SUMMARY OF THE INVENTION

An apparatus of the invention is characterized in that each receiving chamber is connected to at least one substantially vertical pipe, the mounting thereof being such that vertical drops between the pipe's top and bottom end are sufficient for developing a gravitational tube leg in the pipe in which the water is flowing.

A second characteristic feature of the invention is that the amount of water flowing from each water receiving chamber is measured and adjusted for achieving a uniform formation of pulp web in a wedge-shaped space defined by wires.

A third characteristic feature is an orifice strip for delivering water therethrough from a water receiving chamber into a vertical discharge pipe, as well as a compensating circulation for discharging a small amount of water from a water receiving chamber from the side opposite to the discharge pipe. Said perforated strip and said compensating circulation provide for a consistent draining of water from the web across its entire width.

The inventive measuring of the amount of water discharging from a pulp web can be implemented preferably in such a way that the water discharging vertical pipe terminates in a water receiver provided with at least one recess constituted by a sluice element, through which water discharges from the receiver in the form of a sluice flow, said flow being measured by means of a sluice flow meter. The measurement is a simple process, nor is it disturbed by possible impurities, such as air bubbles present in the liquid. It is obvious for a skilled person that the inventive measuring of discharging water can be implemented just as well by other, prior known methods.

As for an apparatus of the invention, it is essential that the vertical drop between the ends of a water discharging pipe be in such a magnitude that the pipe develops a sufficient gravitational tube leg. The vertical drop is preferably 4-10 m.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

The FIGURE shows a schematic of an apparatus according to one embodiment of the present invention implemented in a device for forming the cellulose web.

DETAILED DESCRIPTION OF THE INVENTION

The invention will be described in more detail with reference to the accompanying drawing.

Reference numeral 1 represents a web forming unit, comprising wire elements which establish a wedge-shaped space, the suspension stock being fed into said wedge-shaped space. On the opposite side of the wire are dewatering boxes, comprising several, for example six boxes, both above the top wire section and below the bottom wire section.

From dewatering boxes 2 present in the web forming unit 1, water is passed through orifice strips 3 along pipes 4 and 5 for further processing. These pipes 4 and 5 comprise a comparatively lengthy, substantially vertical section, the purpose of said sections being to function as suction pipes, i.e. to establish a so-called suction leg. As a result of a major vertical drop, a gravitational tube leg is developed by water in the flow pipes for replacing a traditional vacuum pump system on the wire section of a drying machine. It should be noted that the flow rate must be sufficiently high, normally in excess of 2 m/s, for water-entrained impurities like air bubbles and gas bubbles and others to be carried along with the flow instead of becoming deposited e.g. in the upper elements of the apparatus.

A minor amount of water, normally about 10%, is discharged along pipes 6 and 7 from the web forming unit 1 from the side opposite to the pipes 4 and 5. This results in a consistent dewatering across the entire width of a pulp web.

In the web forming unit 1, pressures are measured both on the side of a pulp web and on the side of dewatering boxes. In the dewatering boxes, the pressure is measured both at the ends close to the discharge pipes 4 and 5 and at those close to the discharge pipes 6 and 7.

The discharge pipes 4, 5, 6 and 7 are provided with valve elements for regulating a flow in the pipes.

The discharge pipes 4, 5, 6 and 7 terminate in a water receiver 8, which functions as a water trap. This receiver 8 is provided with at least one recess 9, which is positioned and dimensioned such as to establish a sluice element for the water mass accumulated in the receiver 8. As the dimensions of the recess 9 and flow characteristics of water are known, the flow rate can be determined as based on the height of a liquid level flowing in the recess. According to this height, it is now possible to adjust draining of water as desired from each dewatering box.

In the illustrated solution, the receiver 8 is circular in cross-section, said receiver having its middle section provided with a separate water tank for delivering the sluice flow therein.

The water draining from the receiver 8 in the form of a sluice flow is delivered by means of a pump in a continuous flow along a pipe 10 for further processing.

In the present example, each dewatering chamber 2 is provided with the water discharge pipe 4 and 5, as well as with the extra water discharge pipe 6 and 7 for a balanced dewatering process. It is obvious that the number of discharge pipes can always be varied as necessary without departing from the scope of the invention.

The inventive solution is simple, inexpensive, and effective regarding its implementation. The amount of water to be drained being adjustable specifically in terms of each dewatering chamber and the uniform drainage of water across the entire width of a pulp web improve the pulp web in terms of its quality and uniformity. The suction effect created by a vertical drop increases significantly the capacity of a pulp web former and this augmented capacity is achieved without having to use suction pumps which are expensive in terms of investment and operating costs. Measuring the amount of draining water by means of a sluice level, described as one conceivable implementation, constitutes an inexpensive, accurate, and reliable implementation.

The invention claimed is:

1. An apparatus adapted to drain water from a cellulose web formed in a wedge-shaped space defined by two wires supported by respective chamber assemblies, the chamber assemblies including at least one water-receiving chamber, the wires being configured such that the water from the web flows therethrough into the at least one water-receiving chamber, said apparatus comprising:

a reservoir configured as a sluice for collecting the water therein and adjustably draining the water therefrom; and at least one discharge pipe operably engaged with the at least one water-receiving chamber and adapted to channel the water therefrom into the reservoir, the at least one discharge pipe having a substantially vertical portion with a vertical drop extending between a top end and a bottom end thereof, the substantially vertical portion being configured to cooperate with the reservoir to provide a gravitational suction leg for pulling the water from the at least one water-receiving chamber.

2. An apparatus according to claim 1 wherein the vertical drop extends for between about 4 meters and about 10 meters from the top end to the bottom end.

3. An apparatus according to claim 1 further comprising a regulating element operably engaged with the at least one discharge pipe between the at least one water-receiving chamber and the reservoir, the regulating element being adapted to measure and regulate an amount of the water channeled from the at least one water-receiving chamber to the reservoir.

4. An apparatus according to claim 1 wherein the reservoir further comprises a sluice flow measuring device operably engaged therewith for measuring an amount of the water drained from the reservoir.

5. An apparatus adapted to drain water from a cellulose web formed in a wedge-shaped space defined by two wires supported by respective chamber assemblies, the wires being configured such that the water from the web flows therethrough into one of the chamber assemblies, said apparatus comprising:

at least one water-receiving chamber operably engaged with the chamber assemblies and configured to receive the water flowing from the web through the wires;

a reservoir configured as a sluice for collecting the water therein and adjustably draining the water therefrom; and at least one discharge pipe operably engaged with the at least one water-receiving chamber and configured to channel the water therefrom into the reservoir, the at least one discharge pipe having a substantially vertical portion with a vertical drop extending between a top end and a bottom end thereof, the substantially vertical portion being configured to cooperate with the reservoir to provide a gravitational suction leg for pulling the water from the at least one water-receiving chamber.

6. An apparatus according to claim 5 wherein the vertical drop extends for between about 4 meters and about 10 meters from the top end to the bottom end.

7. An apparatus according to claim 5 further comprising a regulating element operably engaged with the at least one discharge pipe between the at least one water-receiving chamber and the reservoir, the regulating element being adapted to measure and regulate an amount of the water channeled from the at least one water-receiving chamber to the reservoir.

8. An apparatus according to claim 5 wherein the reservoir further comprises a sluice flow measuring device operably engaged therewith for measuring an amount of the water drained from the reservoir.

9. An apparatus according to claim 5 further comprising at least one extra discharge pipe operably engaged with the at least one water-receiving chamber, in generally opposing relation with respect to the at least one discharge pipe, for balancing the water drainage from the web.

10. An apparatus according to claim 9 further comprising at least one orifice strip operably engaged with the at least one water-receiving chamber and configured to direct the water therethrough to at least one of the at least one discharge pipe and the at least one extra discharge pipe.

* * * * *